United States Patent [19]

Wagner et al.

[11] Patent Number: 4,482,086

[45] Date of Patent: Nov. 13, 1984

[54] EXPANDABLE PACKER ASSEMBLY FOR SEALING A WELL SCREEN TO A CASING

[75] Inventors: Walter R. Wagner, Minneapolis; Leslie K. Bearl, Anoka, both of Minn.

[73] Assignee: UOP Inc., Des Plaines, Ill.

[21] Appl. No.: 520,267

[22] Filed: Aug. 4, 1983

[51] Int. Cl.[3] ..... F16J 15/06

[52] U.S. Cl. ..... 277/12; 277/30; 277/116.2; 166/118; 166/134

[58] Field of Search ..... 277/30, 31, 102, 104, 277/114, 116.2, 116.4, 116.6; 166/118, 119, 134–136

[56] References Cited

U.S. PATENT DOCUMENTS

| | | | |
|---|---|---|---|
| 276,116 | 4/1883 | Williamson | 166/118 X |
| 1,649,846 | 11/1927 | Neelands | 277/102 X |
| 1,896,482 | 2/1933 | Crowell | 166/136 X |
| 1,925,015 | 8/1933 | Wells | 277/116.4 X |
| 1,949,498 | 3/1934 | Stone et al. | 277/102 X |
| 2,026,883 | 1/1936 | Gillespie | 277/116.4 X |
| 2,136,597 | 11/1938 | Spang | 277/116.4 X |
| 2,448,205 | 8/1948 | Ashton | 277/102 |
| 2,830,540 | 4/1958 | Vincent | 277/116.4 X |
| 2,988,148 | 6/1961 | Conrad et al. | 277/116.4 X |

*Primary Examiner*—Robert S. Ward

*Attorney, Agent, or Firm*—James R. Hoatson, Jr.; Barry L. Clark; William H. Page, II

[57] ABSTRACT

Improved packer assembly for sealing a well screen to a casing avoids contamination problems of expandable lead packers and the abrasion of self-sealing packers which can be rendered ineffective before they reach their intended depth. A pair of annular end members, adapted to be threaded to the well screen and to the drill stem, are joined by a compressible, tubular metal portion. When the well screen is at its intended depth, a swedge dropped against the upper end member of the packer assembly will compress the ends of the tubular metal portion toward each other while the intermediate portion expands into sealing relation with the casing. The seal can be enhanced by applying rings or layers of elastomeric material to the tubular metal portion.

8 Claims, 4 Drawing Figures

EXPANDABLE PACKER ASSEMBLY FOR SEALING A WELL SCREEN TO A CASING

BACKGROUND OF THE INVENTION

The invention relates to packers and particularly to packers of the type used to seal a well screen relative to a well casing after the well screen has been set in place. The purpose of the packer is to prevent sand in the formation from passing through the connection joint between the well screen and casing. Presently, two general types of packers are in use. Lead packers use an annular block of lead with a smaller O.D. than the casing. The lead block is adapted to deform and wedge radially outwardly into the space between the top of the well screen and the casing when it is repeatedly hammered down with a tapersided swedge block. Although lead seals are relatively effective, there is considerable concern over the possibility that they can introduce contamination into a water supply.

Another commonly used packer arrangement is the so-called self-sealing packer which is made of rubber or other elastomeric material. Typically, such a packer might have the general shape of a funnel with the smaller diameter portion encircling the upper end of the well screen and clamped to it and the conical upper portion resiliently bearing against the inner wall of the casing. Such packers naturally bear against the casing wall all the time they and the well screen are being lowered into position. Where the casing wall is rough and/or the well is deep, there is a considerable risk that the rubber packer will be abraded, thus reducing the sealing pressure or preventing a seal, thereby rendering the packer ineffective.

SUMMARY OF THE INVENTION

It is among the objects of the present invention to provide a packing assembly for sealing a well screen to a casing which will provide an effective seal; will be simple to operate; and will avoid the contamination and abrasion sensitivity problems of prior art lead packers and self-sealing packers.

These and other objects and advantages are attained by the packer assembly of the present invention which includes a pair of spaced ring portions, one of which is adapted to be fastened to the top portion of a well screen and the other of which is adapted to be suspended from a drill stem or other member used to lower the screen down through a well casing. The spaced ring portions are each mounted to an end portion of an elongated tubular member which has a relatively thin wall. The tubular member is shaped so that when an axial compression force is applied to it, a portion intermediate its end portions will deform and assume a permanent shorter length while expanding radially so as to apply a radially outward sealing force against the well casing. The intermediate portion can be of various configurations, including, but not limited to, a corrugated bellows shape or an outwardly convex "barrel" shape. To enhance the integrity of the seal, the tubular member is preferably provided with one or more circumferential bands of rubber or other elastomeric material. In one corrugated bellows-like configuration, a ring of elastomeric material is placed in one or more of the corrugations on the outer surface. When the packer is to be actuated, a compression force applied to the ends of the bellows will serve to axially squeeze the elastomeric ring(s), thus forcing them to move radially outwardly against the casing. Preferably, the bellows-like tube is formed of a material such as stainless or low carbon steel which has very little elasticity in order that it will tend to remain in its compressed shape. In a second "barrel"-shaped configuration, the elastomeric band is preferably quite wide and is bonded to the intermediate portion of the tubular member. In either embodiment, the elastomeric band(s) is arranged so that it will not engage the casing until the well screen is in place and a downward compression load is applied to the upper end ring portion. One advantage of the aforesaid "barrel" configuration is that a greater amount of outward radial movement of the elastomeric sealing band can take place as compared to the corrugated bellows configuration where there is both inward and outward radial movement. The corrugated bellows configuration can offer the advantage of multiple seals since each corrugation can contain an elastomeric ring.

DETAILED DESCRIPTION OF THE DRAWINGS

Figure 1:
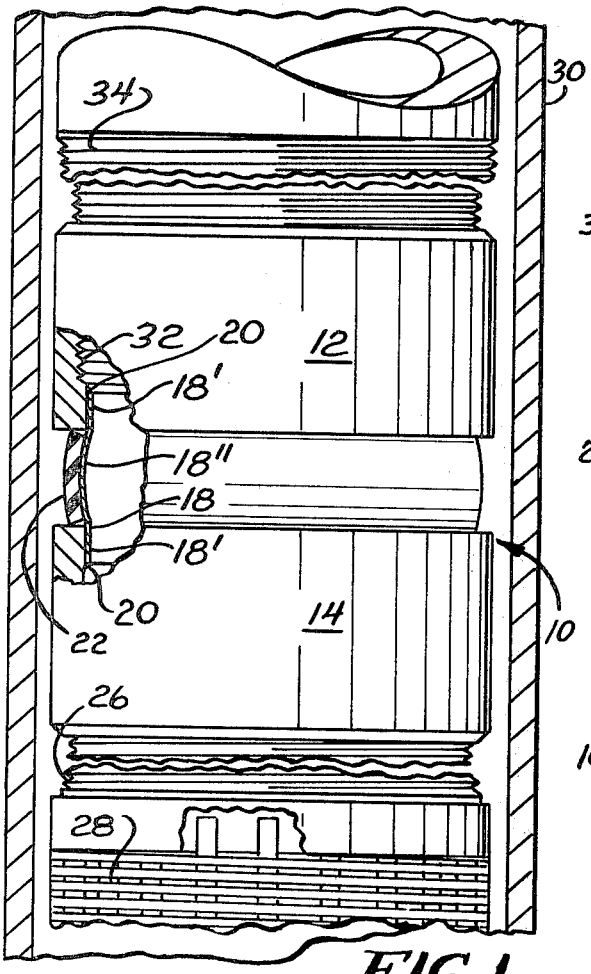
FIG. 1 is a side view, partially broken away and sectioned, showing one embodiment of the inproved packer assembly mounted intermediate a well screen and an adaptor which is carried by a drill stem.

Referring to FIG. 1, the packer assembly indicated generally at 10 can be seen to comprise an upper end ring portion 12, a lower end ring portion 14 and a compressible intermediate tubular connecting portion 18 which is joined to the end rings in a suitable manner, such as by welds 20. An elastomeric sealing means, such as the band 22, is associated with the connecting portion 18 in any suitable manner, such as by adhesive bonding, so that a portion 22 of the band will move radially outwardly when the assembly is compressed. This outward movement is discussed more completely in connection with FIG. 2.

The lower end of ring 14 is preferably provided with a female thread (not shown) which is engaged with a male thread 26 at the upper end of a well screen assembly 28 before the assemblies are lowered in a casing 30. Alternatively, the male and female threads could be reversed or the two assemblies could be welded. Welding is generally less expensive for larger diameters. The upper ring 12 preferably contains a female thread 32 which is adapted to receive an adapter 34 carried by the drill stem (not shown). After the drill stem has lowered the packer and screen assemblies 10 and 28 to their operating or seated position in the casing 30, the adapter 34 is unthreaded from the ring thread 32.

Figure 2:
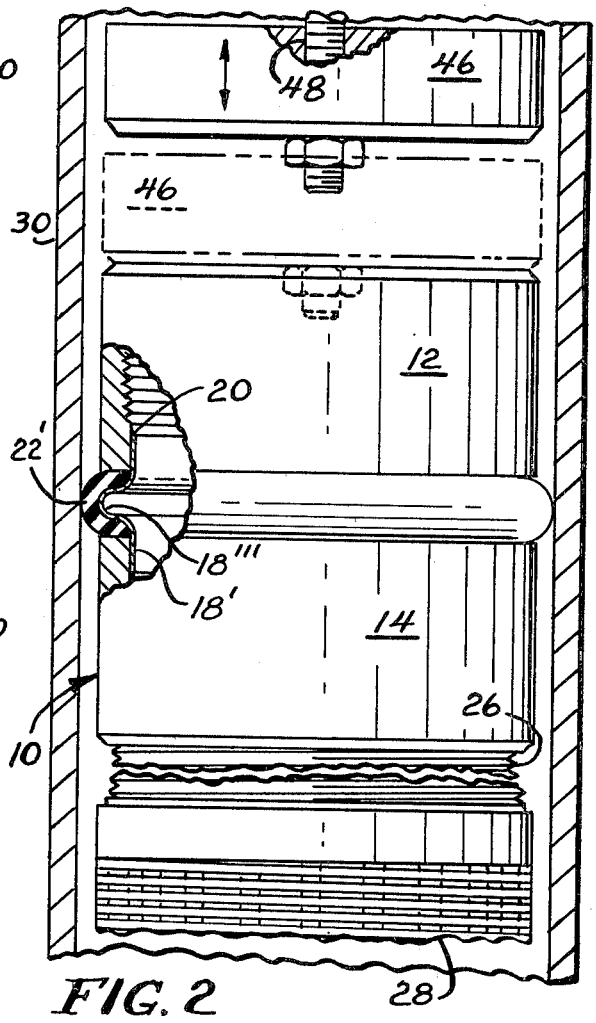
FIG. 2 is a side view of the embodiment of FIG. 1 after the well screen has been positioned in a casing, detached from the drill stem, and compressed with a swedge block dropped against it by the drill stem.

FIG. 2 illustrates how the packer assembly 10 is sealed to the inside wall of the casing 30 after the screen 28 has been lowered to its operating position and the drill stem adapter 34 (FIG. 1) has been disconnnected from the ring 12 and replaced by a swedge block 46 suspended on a support rod 48. If the weight of the swedge block 46 is sufficient it could conceivably compress the assembly 10 to the position shown. However, the block 46 would more typically be lifted one or more times to a height of 1–2 feet above the ring 12 and dropped. The downward force applied by the swedge block would then cause the tubular "barrel-shaped" intermediate metal portion 18″ and the elastomeric band 22 (FIG. 1) to collapse and expand radially outwardly to their FIG. 2 positions 18‴ and 22′, respectively, where they are in sealing contact with the casing 30.

Figure 3:
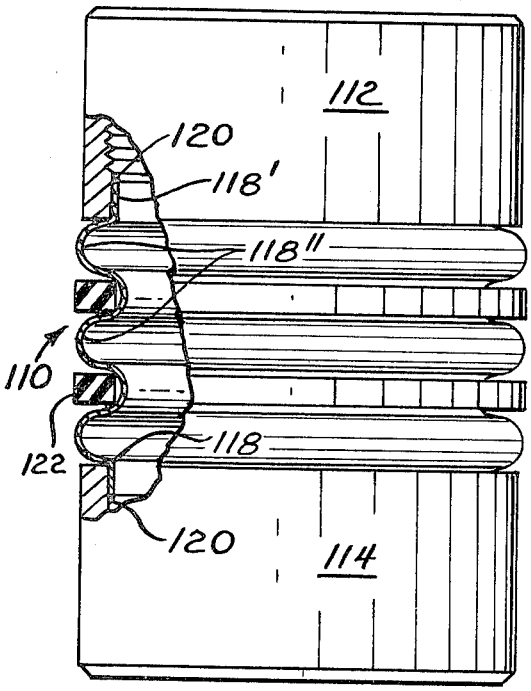
FIGS. 3 and 4 show a modified form of packer assembly in side views similar to FIGS. 1 and 2.
Figure 4:
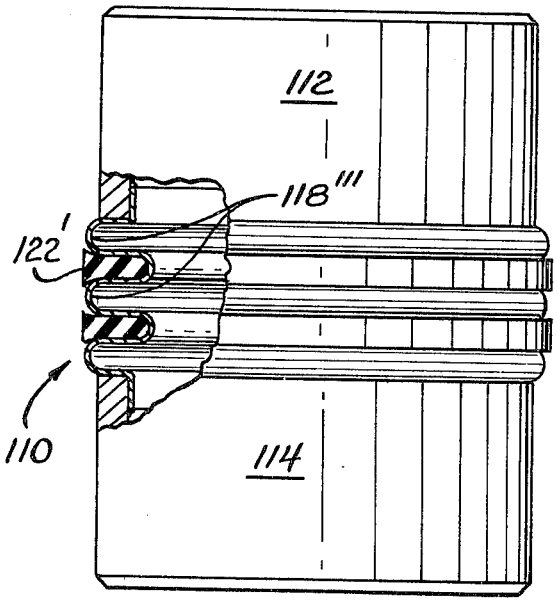

FIGS. 3 and 4 are similar to FIGS. 1 and 2 but illustrate a modified packer assembly 110 which is essentially identical to the assembly 10 except that the tubular metal portion 118 is of a corrugated bellows configuration in the intermediate region 118″. Similar portions are numbered as in FIGS. 1 and 2 but with a "1" inserted before the reference number. The sealing means in FIGS. 3 and 4 comprises one or more annular elastomeric rings 122 which are compressed axially and expanded radially as shown at 122′ when the bellows-like metal portion 118 is compressed from its configuration 118″ to its configuration 118‴. Preferably, a relatively soft elastomer such as neoprene of a durometer of about 40, is used for the rings while the tubular metal portion could be of any suitable material and thickness, such as stainless steel 0.025″ thick.

We claim as our invention:

1. An expandable packer assembly for sealing a well screen member relative to the inner surface of a tubular casing member, said packer assembly including a pair of annular end portions, at least the lower of which includes fastening means adapted to be attached to the upper end of a well screen, said pair of end portions being axially joined to each other solely by an axially compressible tubular portion which has a relatively thin wall compared to said end portions and which is attached to said end portions at its ends in sealing relation thereto, said axially compressible tubular portion having at least one radially outwardly directed, annular intermediate region, said annular intermediate region being shaped so that it will be compressed in an axial direction and expanded outwardly in a radial direction when a predetermined amount of downward force is applied to the upper one of said pair of annular end members relative to the lower one, said annular intermediate region being relatively inelastic so that it will remain compressed when said downward force is removed

2. An expandable packer assembly in accordance with claim 1 wherein elastomeric sealing means are provided on the outer side of said annular intermediate region.

3. An expandable packer assembly in accordance with claim 2 wherein the upper of said pair of annular end portions is a ring having an upwardly directed internal thread and a generally flat annular upper end surface adapted to be contacted by a swedge block.

4. An expandable packer assembly in accordance with claim 2 wherein said annular intermediate region has a generally "barrel-shaped" configuration.

5. An expandable packer assembly in accordance with claim 4 wherein said elastomeric sealing means comprises an elastomeric band bonded to said tubular portion.

6. An expandable packer assembly in accordance with claim 2 wherein said annular intermediate region has a corrugated, bellows-like configuration.

7. An expandable packer assembly in accordance with claim 6 wherein said elastomeric sealing means comprises at least one annular elastomeric ring positioned in an outwardly open corrugation on said tubular portion.

8. An expandable packer assembly in accordance with claim 7 wherein at least two annular elastomeric rings are positioned in at least two outwardly open corrugations on said tubular portion.

* * * * *